US007832387B1

(12) United States Patent
Yehle

(10) Patent No.: US 7,832,387 B1
(45) Date of Patent: Nov. 16, 2010

(54) CENTER-PIVOT LIMBS FOR AN ARCHERY BOW

(75) Inventor: Craig T. Yehle, Junction City, OR (US)

(73) Assignee: Extreme Technologies, Inc., Eugene, OR (US)

( * ) Notice: Subject to any disclaimer, the term of this patent is extended or adjusted under 35 U.S.C. 154(b) by 492 days.

(21) Appl. No.: 11/877,653

(22) Filed: Oct. 23, 2007

Related U.S. Application Data

(60) Provisional application No. 60/863,969, filed on Nov. 1, 2006.

(51) Int. Cl.
*F41B 5/00* (2006.01)
*F41B 5/10* (2006.01)

(52) U.S. Cl. ..... 124/25.6; 124/23.1

(58) Field of Classification Search ..... 124/23.1, 124/25.6, 86, 88
See application file for complete search history.

(56) References Cited

U.S. PATENT DOCUMENTS 4,955,354 A 9/1990 Bozek
5,024,206 A * 6/1991 Lester ..... 124/23.1
5,706,794 A * 1/1998 Neal ..... 124/25.6
6,019,097 A * 2/2000 Cox et al. ..... 124/23.1
6,029,644 A * 2/2000 Bronnert ..... 124/25.6
6,712,057 B2 3/2004 Andrews
6,786,214 B2 9/2004 Andrews
2006/0011181 A1 * 1/2006 Andrews ..... 124/23.1

OTHER PUBLICATIONS

Co-owned U.S. Appl. No. 12/394,652, filed Feb. 27, 2009.

* cited by examiner

*Primary Examiner*—John Ricci
(74) *Attorney, Agent, or Firm*—David S. Alavi

(57) ABSTRACT

An archery bow comprises an elongated riser, two coupling members, and two bow limbs. The riser has a pair of distal pivotable connection points, a pair of proximal pivotable connection points between the distal connection points, and a central handle portion between the proximal connection points. Each coupling member is pivotably connected at a first pivotable connection point thereof to the riser at a corresponding proximal connection point thereof. Each bow limb is pivotably connected to the riser at a corresponding distal pivotable connection point thereof and pivotably connected to a corresponding coupling member at a second pivotable connection point thereof. Each bow limb is adapted at a pulley pivotable connection point thereof to receive a pulley member pivotably connected thereto.

22 Claims, 6 Drawing Sheets

CENTER-PIVOT LIMBS FOR AN ARCHERY BOW

BENEFIT CLAIMS TO RELATED APPLICATIONS

This application claims benefit of U.S. provisional App. No. 60/863,969 filed Nov. 1, 2006 in the name of Craig T. Yehle, said provisional application being hereby incorporated by reference as if fully set forth herein.

BACKGROUND

The field of the present invention relates to archery bows. In particular, an archery bow having center-pivot limbs and methods for manufacturing an archery bow incorporating such limbs are disclosed herein.

Previous limbs for archery bows typically are secured near one end thereof to a riser, and can be referred to as end-pivot limbs for purposes of this disclosure. Upon drawing the bow, the limbs are deformed as the energy expended in drawing the bow is stored as strain energy of the deformed limbs. This energy is then released as kinetic energy of the arrow when the bow is shot and the limbs return to their original, unstrained shape.

End-pivot limbs typically are subject to localized forces and stresses that are substantially magnified by the lever arm of the limb (roughly, the overall limb length divided by the limb length in contact with the riser). The bending moment and effective moment of inertia typically are largest for a limb with a pivot point near one end. It may be desirable to provide a bow limb having a pivot point nearer to the center of the limb than in previous bows.

SUMMARY

An archery bow comprises an elongated riser, first and second coupling members, and first and second elongated bow limbs. The riser has a central handle portion, first and second proximal pivotable connection points arranged on the riser with the handle portion therebetween, and first and second distal pivotable connection points arranged on the riser with the handle portion and the proximal connection points therebetween. The first coupling member is pivotably connected at a first pivotable connection point thereof to the riser at the first proximal pivotable connection point thereof. The first bow limb is pivotably connected to the riser at the first distal pivotable connection point thereof and pivotably connected to the first coupling member at a second pivotable connection point thereof. The first bow limb is adapted at a pulley pivotable connection point thereof to receive a pulley member pivotably connected thereto. The second coupling member is pivotably connected at a first pivotable connection point thereof to the riser at the second proximal pivotable connection point thereof. The second bow limb is pivotably connected to the riser at the second distal pivotable connection point thereof and pivotably connected to the second coupling member at a second pivotable connection point thereof. The second bow limb is adapted at a pulley pivotable connection point thereof to receive a pulley member pivotably connected thereto. A coupling member can be connected to the limb with the riser connection point positioned along the limb between its coupling member and pulley connection points, or a substantially rigid coupling member can be connected to the limb at the coupling member connection point positioned along the limb between its riser and pulley connection points.

Objects and advantages pertaining to bows with center-pivot bow limbs may become apparent upon referring to the exemplary embodiments illustrated in the drawings or disclosed in the following written description or appended claims.

The embodiments shown in the Figures are exemplary only, and should not be construed as limiting the scope of the present disclosure or appended claims.

DETAILED DESCRIPTION OF EMBODIMENTS

Figure 1:
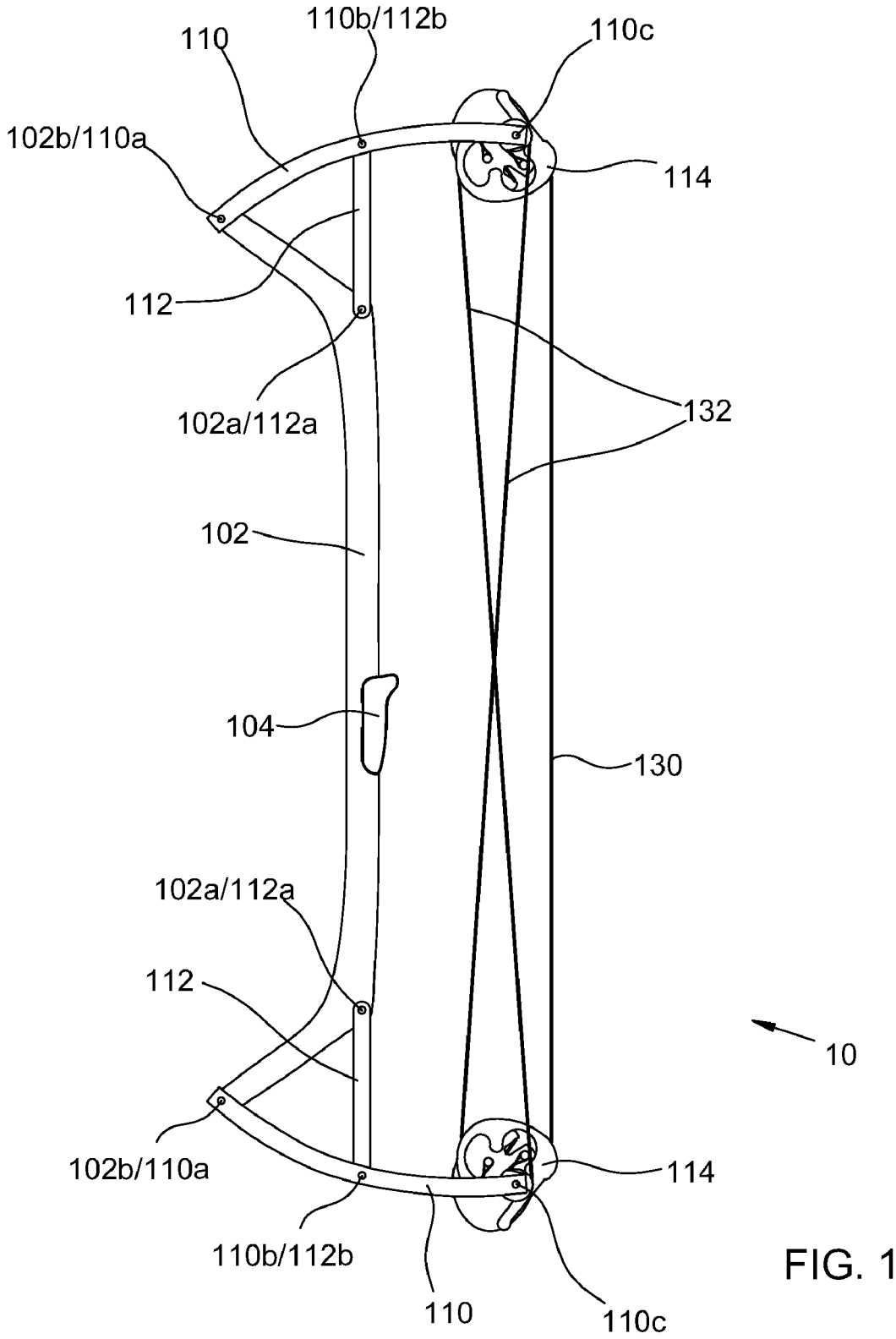
FIGS. 1 and 2A-2B illustrate schematically an exemplary embodiment of a bow with center-pivot limbs.
Figure 2A:
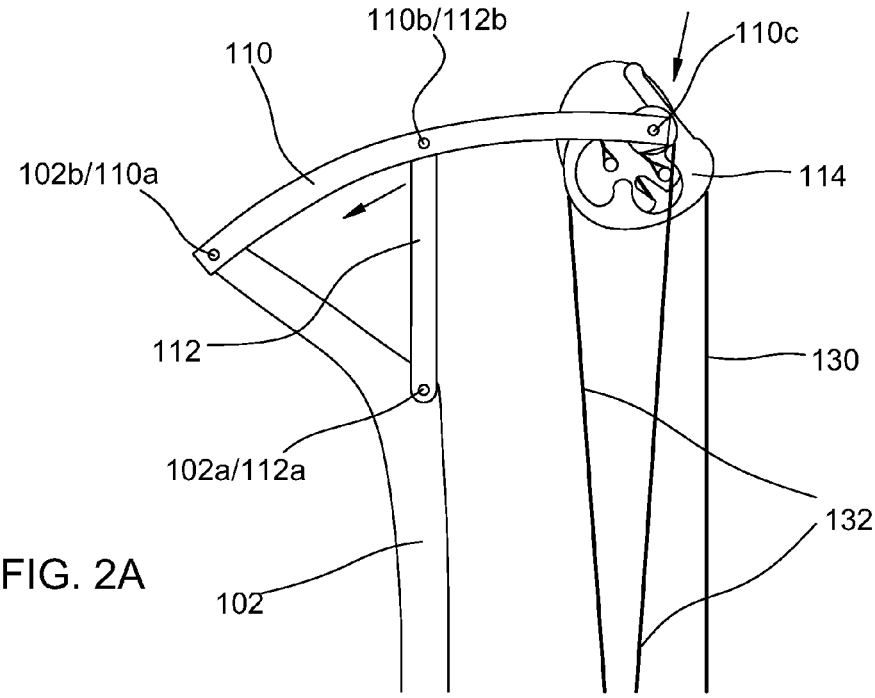
Figure 2B:
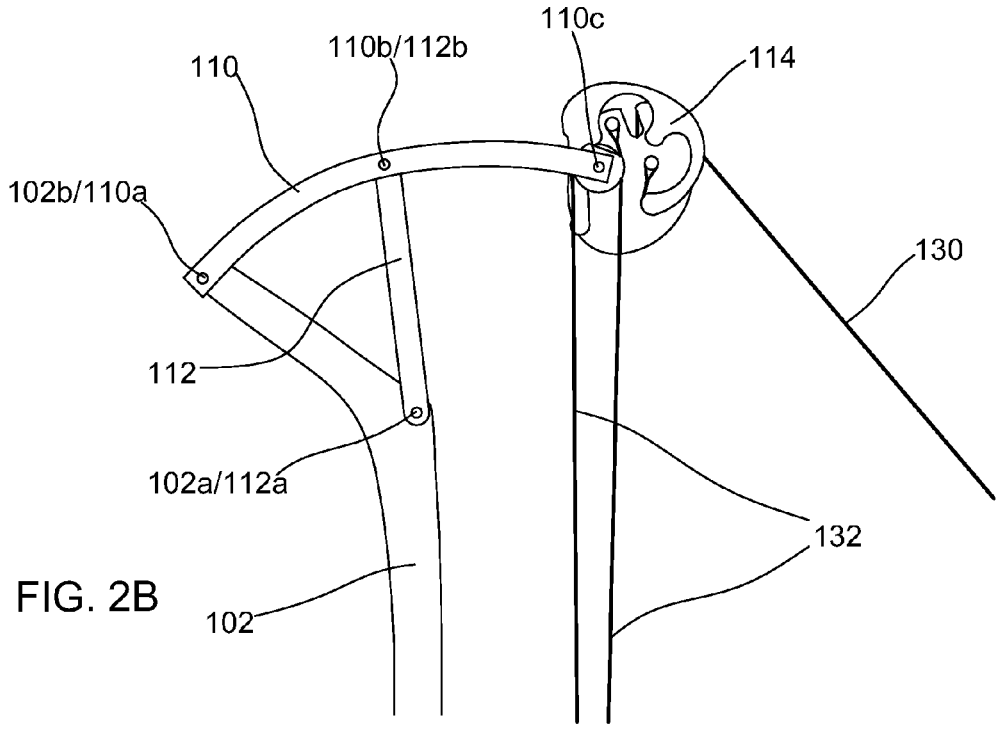
Figure 3:
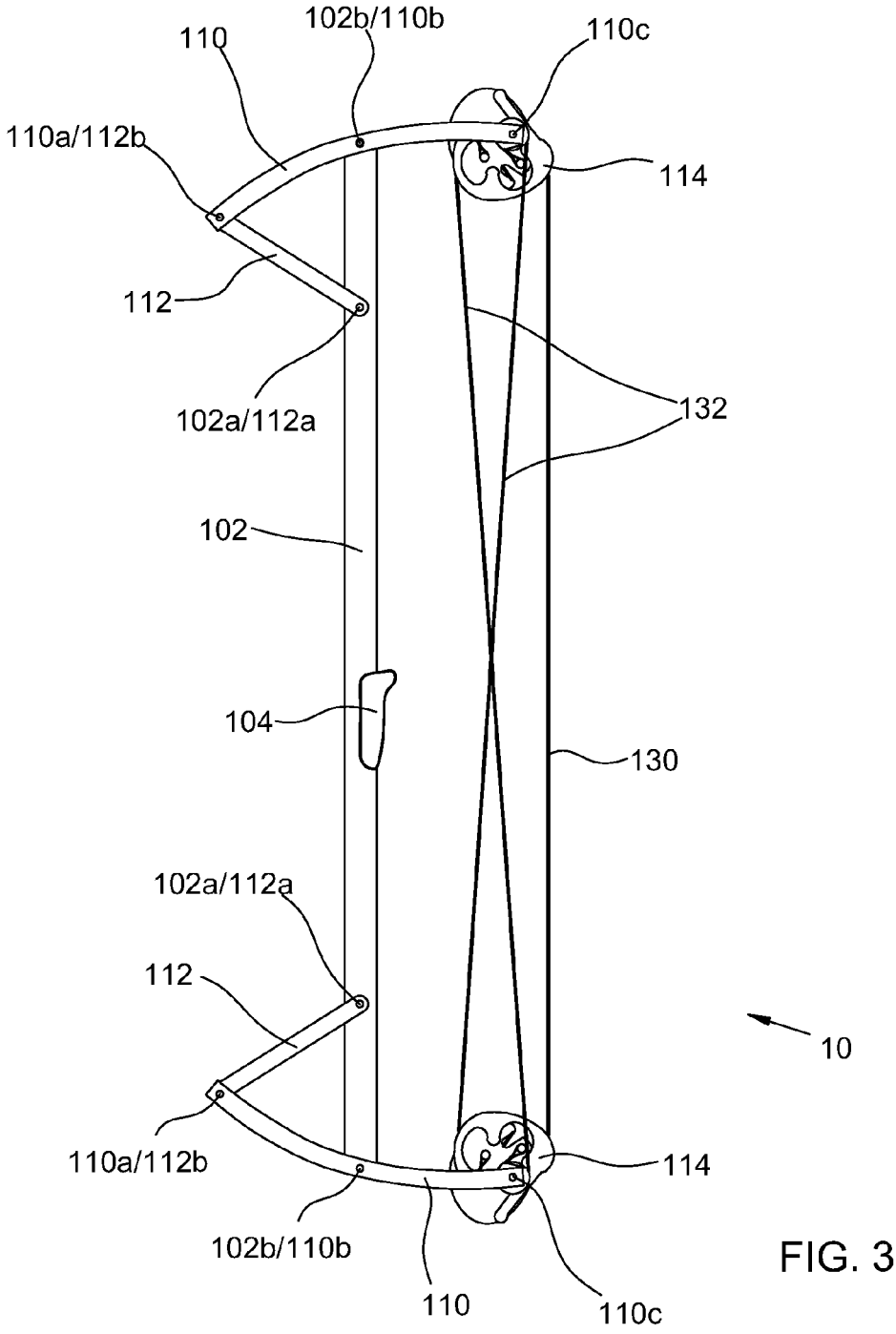
FIGS. 3 and 4A-4B illustrate schematically another exemplary embodiment of a bow with center-pivot limbs.
Figure 4A:
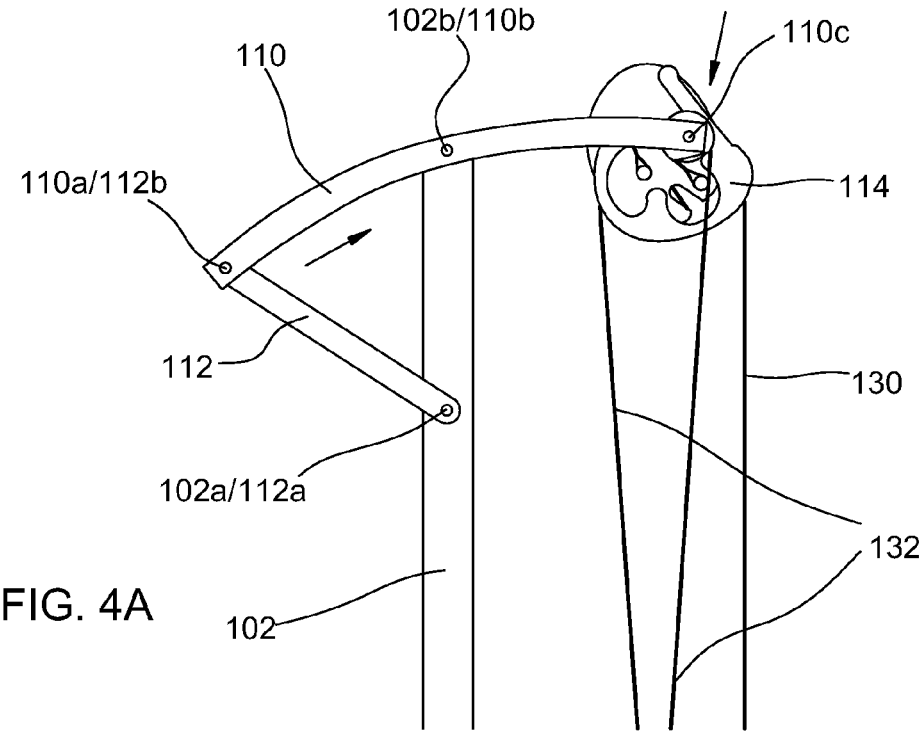
Figure 4B:
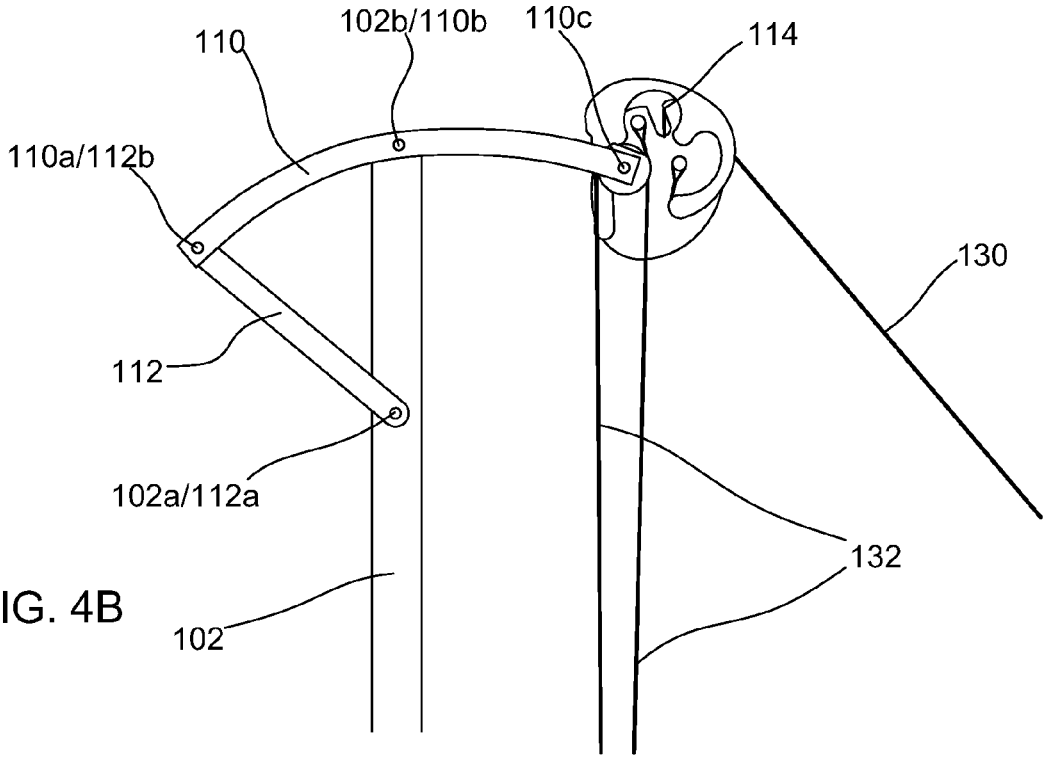

A first exemplary embodiment of an archery bow 10 incorporating center-pivot limbs is illustrated schematically in FIGS. 1, 2A, and 2B. A second exemplary embodiment of archery bow 10 incorporating center-pivot limbs is illustrated schematically in FIGS. 3, 4A, and 4B. It should be noted that while the term "center-pivot" is used herein to describe the disclosed bow limbs, it is not necessarily the case that the bow limb has a pivot point precisely at its center; a center-pivot limb as disclosed herein has a pivot point somewhere along its length between two other pivot points thereon, as described hereinbelow. In each embodiment the bow comprises an elongated riser 102 with a handle portion 104, two coupling members 112, two bow limbs 110, and two pulley members 114. The bow limbs 110 and coupling members 112 typically are substantially identical and substantially symmetrically arranged on bow 10, but this need not always be the case. Such a symmetrical arrangement is assumed in the following discussion, but asymmetric arrangements shall also fall within the scope of the present disclosure or appended claims. One or both of the pulley members 114 can comprise a cam assembly including a journal for letting out draw string 130. Such a cam assembly can also include a journal for taking up or letting out a power cable 132, or can include additional journals, posts, or other functionally equivalent structures, e.g., for letting out a let-out/take-up cable in a single-cam bow, for taking up or letting out a power cable in a single- or dual-cam bow, and so on. Alternatively, one or both of the pulley members 114 can comprise an idler wheel. The examples in the Figures are dual-cam bows, in which both pulley members are cam assemblies. Single- or solo-cam bows (in which one pulley member is a cam assembly and the other is an idler wheel) or bows having idler wheels on both limbs shall also fall within the scope of the present disclosure or appended claims. Any suitable combination or arrangement of pulley members, cam assemblies, idler wheels, draw cables, power cables, let-out/take-up cables, or similar elements can be employed within the scope of the present disclosure or appended claims.

The elongated riser 102 has first and second distal pivotable connection points 102*b*, first and second proximal pivotable connection points 102*a* arranged on the riser between the distal connection points 102*b*, and a central handle portion 104 arranged on the riser 102 between the proximal connection points 102*a*. A first coupling member 112 is pivotably connected at a first pivotable connection point thereof 112*a* to the riser 102 at the first proximal pivotable connection point thereof 102*a*. A second coupling member 112 is pivotably connected at a first pivotable connection point thereof 112*a* to the riser 102 at the second proximal pivotable connection point thereof 102*a*. A first elongated bow limb 110 is pivotably connected to the riser 102 at the first distal pivotable connection point thereof 102*b* and pivotably connected to the first coupling member 112 at a second pivotable connection point thereof 112*b*. A second elongated bow limb 110 is pivotably connected to the riser 102 at the second distal pivotable connection point thereof 102*b* and pivotably connected to the second coupling member 112 at a second pivotable connection point thereof 112*b*. Both of the first and second bow limbs 110 are adapted at a pulley pivotable connection point thereof 110*c* to receive a pulley member (e.g., a cam assembly or an idler wheel) pivotably connected thereto. A first cam assembly 114 (or an idler wheel or other pulley member; not shown) is pivotably connected to the first bow limb 110 at the pulley pivotable connection point thereof 110*c*, while a second cam assembly 114 (or an idler wheel or other pulley member; not shown) is pivotably connected to the second bow limb 110 at the pulley pivotable connection point thereof 110*c*. A draw cable 130 and power cables 132 are shown engaged with the first and second cam assemblies 114.

The bow limbs 110 typically comprise a material or a combination of materials that are deformable, and that typically are substantially resiliently deformable. Drawing the bow typically results in deformation of the bow limbs and storage of potential energy therein (typically as strain energy). This energy is supplied by the force applied while drawing the bow, and is subsequently at least partially released and transferred to the arrow as kinetic energy when the bow is shot and the limbs return to a resting, non-strained shape (typically substantially the same shape as the original non-deformed shape). Any known or hereafter-developed material or material combination can be incorporated into the bow limbs 110 while remaining within the scope of the present disclosure or appended claims.

The "pivotable connections" among the riser 102, the limbs 110, or the coupling members 112 can include any type of mechanical connection that allows a necessary or desired degree of relative angular motion between members thus connected. For example, a pivotable connection between two members (riser to coupling member, riser to limb, or coupling member to limb) can be formed by an axle passing at least partly through each of the connected members. Each of the members pivotably connected by the axle can be configured or adapted therefor, e.g., by including at the corresponding connection point a forked portion, a slotted or recessed portion, a protruding portion, or other similar adaptation or structure for accommodating the axle. Other pivotable connections can be employed while remaining within the scope of the present disclosure or appended claims. Such connections may include but are not limited to: axles; clevis pins; other pins; hinges; articulated joints; flexure bearings or linkages; deformable integral structures (deformable only near the connection point or deformable over an extended region of one or both integral members); other suitable connections known or hereafter developed that provide a needed or desired degree of relative angular motion.

The draw cable 130, power cables 132, and cam assemblies 114 in the exemplary embodiments of the figures are arranged so that pulling the draw cable 130 to draw the bow 10 results in deformation of the bow limbs 110 and pivoting movement of the coupling members 112 (as illustrated in FIGS. 2A-2B and 4A-4B). Each coupling member 112 and the riser 102 are arranged so that the pivoting movement of the coupling member 112 as the bow 10 is drawn results in a decrease of the acute angle between the riser 102 and the coupling member 112 (relative to the acute angle when the bow is "at brace", i.e., in a resting configuration prior to drawing the bow). The riser 102, coupling members 112, and bow limbs 110 are arranged so that the deformation of the bow limbs 110 results in movement of the respective pulley connection points 110*c* toward one another.

The coupling members 112 (which also may be referred to as "tie-rods" or other suitable alternative terminology) can comprise any suitable material or combination of materials. In some embodiments the coupling members 112 are substantially rigid, and can comprise one or more of metal, polymer, composite, combinations thereof, and so on. This may be suitable in embodiments wherein the coupling members 112 are subject to compressive forces at brace or during drawing of the bow (as in FIGS. 1, 2A-2B, and 5), but may also be suitable in embodiments wherein the coupling members 112 are subject to tensile forces a brace or during drawing of the bow (as in FIGS. 3, 4A-4B, and 6). In some other embodiments the coupling members 112 are flexible but substantially non-expandable or non-stretchable, and can comprise flexible cables, flexible bands, and the like (comprising one or more of metal, polymer, composite, combinations thereof, and so on). This may be suitable in embodiments wherein the coupling members 112 are subject to tensile forces at brace or during drawing of the bow (as in FIGS. 3, 4A-4B, and 6). In some other embodiments arranged as shown in FIGS. 3, 4A-4B, and 6 (in which the coupling members are subject to tensile forces) the coupling members 112 can be extendable or stretchable, typically substantially resiliently extendable or stretchable. Such extendable or stretchable coupling members 112 can be deformable to any degree suitable, needed, or desired for a given bow. Such stretchable or extendable coupling members can comprise deformable material similar to or differing from that of the bow limbs, springs or spring-like material, elastic material, and so on, including any suitable known or hereafter-developed materials or structures.

In a first embodiment of a bow 10 with center-pivot limbs 110 (FIGS. 1 and 2A-2B), each coupling member 112 is connected (at its connection point 112*b*) to the corresponding bow limb 110 at a coupling member pivotable connection point 110*b* on the bow limb 110 between the cam connection point thereof 110*c* and a riser pivotable connection point 110*a* where the riser 102 is connected (at its distal connection point 102*b*) to the bow limb 110. As the bow 10 is drawn and the bow limb 110 deforms, the acute angle between the coupling member 112 and the riser 102 decreases and the riser and coupling member connection points 110*a* and 110*b* move toward one another. The portion of the riser 102 between the proximal connection point 102*a* and the distal connection point 102*b* is subject to a tensile force, while the coupling member 112 is subject to a compressive force.

In a second embodiment of a bow 10 with center-pivot limbs 110 (FIGS. 3 and 4A-4B), the riser 102 is connected (at distal connection point 102*b*) to the corresponding bow limb 110 at a riser connection point 110*b* on the bow limb 110 between the pulley connection point thereof 110*c* and a coupling member connection point 110*a* where coupling member 112 is connected (at connection point 112*b*) to the bow limb 110. As the bow 10 is drawn and the bow limb 110 deforms, the acute angle between the coupling member 112 and the riser 102 decreases and the coupling member and riser connection points 110*a* and 110*b* move toward one another. The portion of the riser 102 between the proximal connection point 102*a* and the distal connection point 102*b* is subject to a compressive force, while the coupling member 112 is subject to a tensile force.

In either of the exemplary embodiments, the connection point 110*b* can be located on the bow limb 110 about midway between the cam connection point thereof 110*c* and the connection point 110*a*, or within about the middle eighth of the length between the connection points of the bow limb (i.e., between about 44% and about 56% of the distance between the connection points of the bow limb), or within about the middle quarter (i.e., between about 38% and about 62%) of the length between the connection points of the bow limb, or within about the middle third (i.e., between about 33% and about 66%) of the length between the connection points of the bow limb, or within about the middle half (i.e., between about 25% and about 75%) of the length between the connection points of the bow limb, or in any other suitable, needed, or desired position between the connection points of the bow limb. In either of the exemplary embodiments, the connection point 110*a* and the cam connection point 110*c* can be located at corresponding opposite ends of the bow limb 110 or at any other suitable, needed, or desired position on the bow limb. In either of the exemplary embodiments, the connection points 112*a* and 112*b* can be located at corresponding opposite ends of the coupling member 112, or at any other suitable, needed, or desired position on the coupling member. In the exemplary embodiment of FIGS. 1 and 2A-2B, the proximal pair of pivotable connection points 102*a* and the pivotable connection points 112*a* and 112*b* of the first and second coupling members can be arranged substantially collinearly, or can be arranged in any other suitable, needed, or desired geometry. In the exemplary embodiment of FIGS. 3 and 4A-4B, the pairs of proximal pivotable connection points 102*a* and distal pivotable connection points 102*b* can be arranged substantially collinearly, or can be arranged in any other suitable, needed, or desired geometry. Alternative locations or arrangements for any of these pivotable connection points can be employed within the scope of the present disclosure or appended claims.

Figure 5:
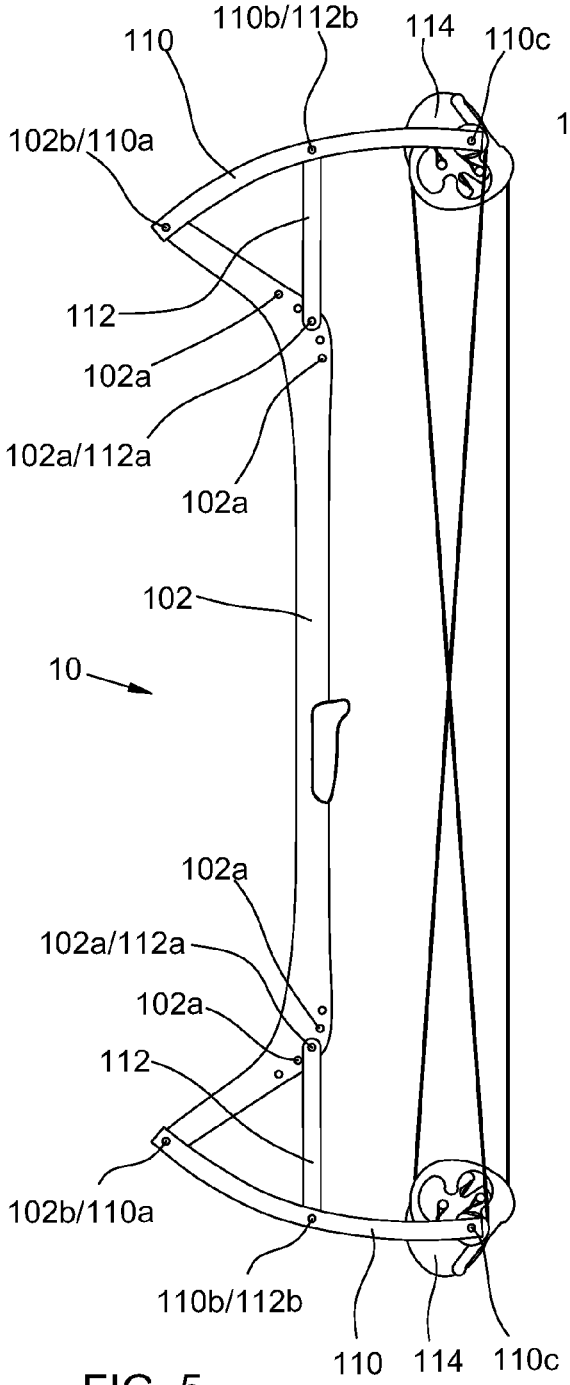
FIGS. 5 and 6 illustrate schematically other exemplary embodiments of a bow with center-pivot limbs.
Figure 6:
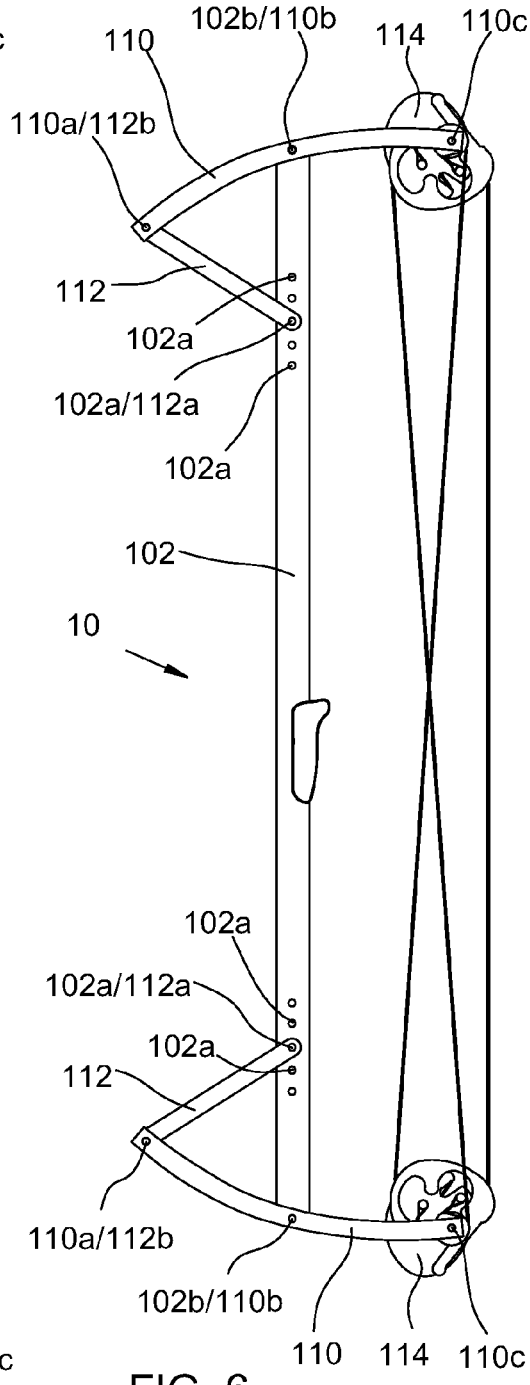

In either exemplary embodiment the riser 102 can have multiple pairs of proximal pivotable connection points 102*a* (as in FIGS. 5 and 6). The coupling members 112 can be connected to riser 102 at any selected one of the multiple proximal connection points 102*a*. The various locations on the riser 102 of the multiple proximal connection points 102*a* enables modification of the draw force characteristics of the bow 10.

Figure 7A:
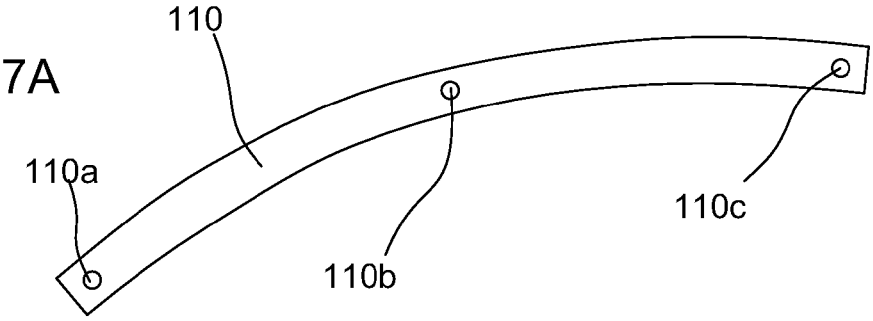
FIGS. 7A-7B and 8A-8B illustrate schematically exemplary embodiments of a center-pivot bow limb.
Figure 7B:
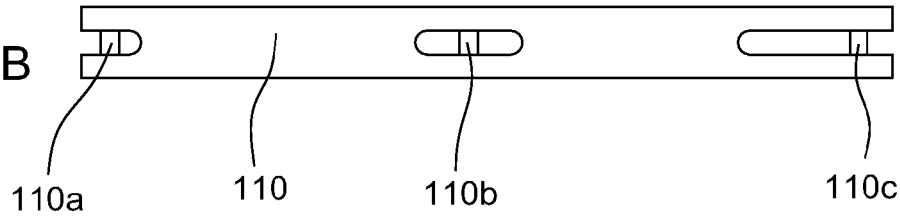
Figure 8A:
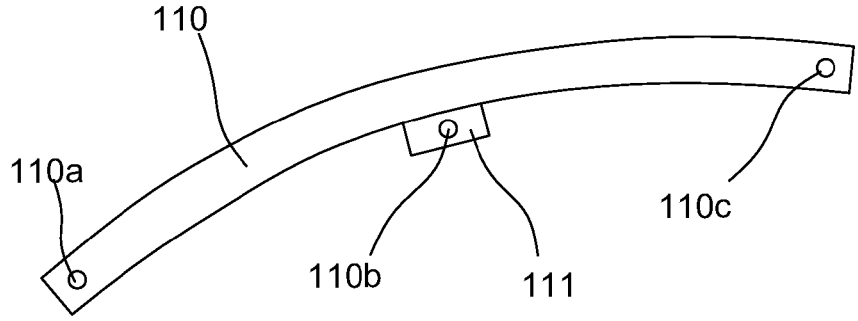
Figure 8B:
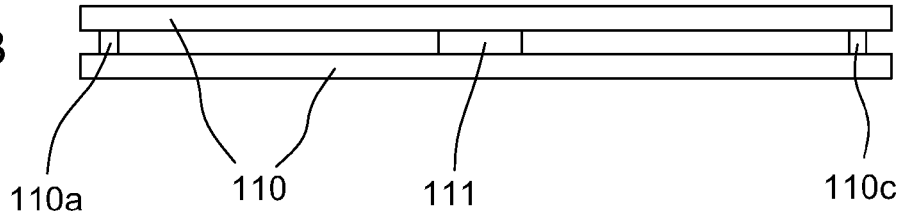

The bow limbs 110 can assume any suitable configuration. In one example, each bow limb 110 comprises a single, integral, elongated member (FIGS. 7A-7B). In another example, each bow limb 110 comprises a pair of substantially parallel, spaced-apart, elongated members (FIGS. 8A-8B). Such a bow limb 110 comprising a pair of elongated members may further comprise a transverse member 111 secured to each of the pair of elongated members. The connection point 110*b* can be located on transverse member 111 or directly on the elongated members. These and any other suitable bow limb configurations or arrangements shall fall within the scope of the present disclosure or appended claims.

Any of the pivotable connection points can be adapted or arranged to dampen vibrations that might arise when the bow is fired. For example, such an arrangement or adaptation can include vibration-dampening material (e.g., polymer) deposited at or near a pivotable connection point. A layer of such a vibration-dampening material could be deposited between transverse member 111 and bow limb 110 in the exemplary embodiment of FIGS. 8A-8B, for example.

Bow-limbs configured according to the present disclosure (i.e., so-called "center-pivot" limbs) can provide one or more advantages over previous bow limbs (referred to herein as "end-pivot" for convenience). End-pivot limbs typically are secured at one end thereof to the riser. This results in localized forces and stresses on the limb that are substantially magnified by the lever arm of the limb (roughly, the overall limb length divided by the limb length in contact with the riser). By placing the pivot point 110*b* relatively nearer to the center of the limb 110, such shear localized forces and stresses can be reduced substantially without substantially reducing the energy stored by deformation of the limbs 110. Magnification can be substantially eliminated by centering pivot point 110*b* between pivot points 110*a* and 110*c*. Placement of the pivot point 110*b* relatively nearer to the center of limbs 110 can result in a reduced bending moment and therefore in an increased effective stiffness-to-mass ratio. The effective moment of inertia for motion of the limb about its pivot point can be reduced by up to almost one-half for a center-pivot limb relative to an end-pivot limb. The reduced moment of inertia can result in less stored potential energy of the drawn bow being wasted as kinetic energy of limb movement. The location of pivot point 110*b* relatively nearer to the center of limb 110 typically shifts the resonance frequency of the limb upward, which can result in reduced limb vibrations (relative to an end-pivot limb). Movement of the coupling members 112 can also serve to cancel out some of the recoil arising from movement of other parts of the bow. This latter mechanism appears to be more pronounced for the embodiment of FIGS. 1 and 2A-2B. In addition to positioning the pivot point 110*b* near the center of the limb 110, in some instances it can also be advantageous to arrange the limb 110 with a mass or stiffness distribution that is substantially symmetric about the pivot point 110*b*. It has been observed that such an arrangement appears to reduce vibration of the bow limb during firing of the bow.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

For purposes of the present disclosure or appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: i) it is explicitly stated otherwise, e.g., by use of "either . . . or", "only one of . . . ", or similar language; or ii) two or more of the listed alternatives are mutually exclusive within the particular context, in which case "or" would encompass only those combinations involving non-mutually-exclusive alternatives.

For purposes of the present disclosure or appended claims, the words "comprise", "comprising", "include", "including", "have", "having" and so on are intended as open-ended terminology, with the same meaning as if the phrase "at least" were appended after each instance thereof.

What is claimed is:

1. An archery bow comprising:

an elongated riser having a central handle portion, first and second proximal pivotable connection points arranged along the riser with the handle portion therebetween, and first and second distal pivotable connection points arranged along the riser with the handle portion and the proximal connection points therebetween;

a first substantially rigid coupling member having first and second pivotable connection points, the first coupling member being pivotably connected at its first pivotable connection point to the riser at the first proximal pivotable connection point of the riser;

a first elongated bow limb having a riser pivotable connection point, a pulley pivotable connection point, and a coupling member pivotable connection point between the riser and pulley pivotable connection points along the first bow limb, the first bow limb being pivotably connected at its riser pivotable connection point to the riser at the first distal pivotable connection point of the riser and pivotably connected at its coupling member pivotable connection point to the first coupling member at the second pivotable connection point of the first coupling member, the first bow limb being adapted at its pulley pivotable connection point to receive a pulley member pivotably connected thereto;

a second substantially rigid coupling member having first and second pivotable connection points, the second coupling member being pivotably connected at its first pivotable connection point to the riser at the second proximal pivotable connection point of the riser; and a second elongated bow limb having a riser pivotable connection point, a pulley pivotable connection point, and a coupling member pivotable connection point between the riser and pulley pivotable connection points along the second bow limb, the second bow limb being pivotably connected at its riser pivotable connection point to the riser at the second distal pivotable connection point of the riser and pivotably connected at its coupling member pivotable connection point to the second coupling member at the second pivotable connection point of the second coupling member, the second bow limb being adapted at its pulley pivotable connection point to receive a pulley member pivotably connected thereto, wherein:

the coupling member pivotable connection point of the first bow limb is positioned within about the middle third of the length along the first bow limb between its riser pivotable connection point and its pulley pivotable connection point; and the coupling member pivotable connection point of the second bow limb is positioned within about the middle third of the length along the second bow limb between its riser pivotable connection point and its pulley pivotable connection point.

2. The bow of claim 1 wherein:

the coupling member pivotable connection point of the first bow limb is positioned within about the middle eighth of the length along the first bow limb between its riser pivotable connection point and its pulley pivotable connection point; and the coupling member pivotable connection point of the second bow limb is positioned within about the middle eighth of the length along the second bow limb between its riser pivotable connection point and its pulley pivotable connection point.

3. The bow of claim 1 wherein the first and second proximal pivotable connection points and the second pivotable connection points of each of the first and second coupling members are arranged substantially collinearly.

4. The bow of claim 1 further comprising:

a first pulley member pivotably connected to the first bow limb at the pulley pivotable connection point thereof;

a second pulley member pivotably connected to the second bow limb at the pulley pivotable connection point thereof; and a draw cable engaged with the first and second pulley members, wherein:

the first or second pulley member and the engaged draw cable are arranged so that pulling the draw cable to draw the bow results in deformation of the first and second bow limbs and pivoting movement of the first and second coupling members;

the first coupling member and the riser are arranged so that the pivoting movement of the first coupling member results in a decrease of an acute angle between the riser and the first coupling member;

the second coupling member and the riser are arranged so that the pivoting movement of the second coupling member results in a decrease of an acute angle between the riser and the second coupling member; and the riser, the first coupling member, the first bow limb, the second coupling member, and the second bow limb are arranged so that the deformation of the first and second bow limbs results in movement of the corresponding pulley pivotable connection points toward one another.

5. The bow of claim 1 wherein:

the riser has multiple first proximal pivotable connection points arranged along the riser between the handle portion and the first distal pivotable connection point, and the first coupling member is pivotably connected at its first pivotable connection point to the riser at one of the multiple first proximal pivotable connection points thereof; and the riser has multiple second proximal pivotable connection points arranged along the riser between the handle portion and the second distal pivotable connection point, and the second coupling member is pivotably connected at its first pivotable connection point to the riser at one of the multiple second proximal pivotable connection points thereof.

6. An archery bow comprising:

an elongated riser having a central handle portion, first and second proximal pivotable connection points arranged along the riser with the handle portion therebetween, and first and second distal pivotable connection points arranged along the riser with the handle portion and the proximal connection points therebetween;

a first substantially rigid coupling member having first and second pivotable connection points, the first coupling member being pivotably connected at its first pivotable connection point to the riser at the first proximal pivotable connection point of the riser;

a first elongated bow limb having a riser pivotable connection point, a pulley pivotable connection point, and a coupling member pivotable connection point between the riser and pulley pivotable connection points along the first bow limb, the first bow limb being pivotably connected at its riser pivotable connection point to the riser at the first distal pivotable connection point of the riser and pivotably connected at its coupling member pivotable connection point to the first coupling member at the second pivotable connection point of the first coupling member, the first bow limb being adapted at its pulley pivotable connection point to receive a pulley member pivotably connected thereto;

a second substantially rigid coupling member having first and second pivotable connection points, the second coupling member being pivotably connected at its first pivotable connection point to the riser at the second proximal pivotable connection point of the riser; and a second elongated bow limb having a riser pivotable connection point, a pulley pivotable connection point, and a coupling member pivotable connection point between the riser and pulley pivotable connection points along the second bow limb, the second bow limb being pivotably connected at its riser pivotable connection point to the riser at the second distal pivotable connection point of the riser and pivotably connected at its coupling member pivotable connection point to the second coupling member at the second pivotable connection point of the second coupling member, the second bow limb being adapted at its pulley pivotable connection point to receive a pulley member pivotably connected thereto, wherein:

each bow limb comprises a corresponding pair of substantially parallel, spaced-apart, elongated members and a corresponding transverse member secured to each of the corresponding pair of elongated members; and the corresponding coupling member pivotable connection point of each bow limb is located on the corresponding transverse member.

7. An archery bow comprising:

an elongated riser having a central handle portion, first and second proximal pivotable connection points arranged on the riser with the handle portion therebetween, and first and second distal pivotable connection points arranged on the riser with the handle portion and the proximal connection points therebetween;

a first coupling member having first and second pivotable connection points, the first coupling member being pivotably connected at its first pivotable connection point to the riser at the first proximal pivotable connection point of the riser;

a first elongated bow limb having a coupling member pivotable connection point, a pulley pivotable connection point, and a riser pivotable connection point between the coupling member and pulley pivotable connection points along the first bow limb, the first bow limb being pivotably connected at its riser pivotable connection point to the riser at the first distal pivotable connection point of the riser and pivotably connected at its coupling member pivotable connection point to the first coupling member at the second pivotable connection point of the first coupling member, the first bow limb being adapted at its pulley pivotable connection point to receive a pulley member pivotably connected thereto;

a second coupling member having first and second pivotable connection points, the second coupling member being pivotably connected at its first pivotable connection point to the riser at the second proximal pivotable connection point of the riser; and a second elongated bow limb having a coupling member pivotable connection point, a pulley pivotable connection point, and a riser pivotable connection point between the coupling member and pulley pivotable connection points along the second bow limb, the second bow limb being pivotably connected at its riser pivotable connection point to the riser at the second distal pivotable connection point of the riser and pivotably connected at its coupling member pivotable connection point to the second coupling member at the second pivotable connection point of the second coupling member, the second bow limb being adapted at its pulley pivotable connection point to receive a pulley member pivotably connected thereto.

8. The bow of claim 7 wherein:

the riser pivotable connection point of the first bow limb is positioned within about the middle third of the length along the first bow limb between its coupling member pivotable connection point and its pulley pivotable connection point; and the riser pivotable connection point of the second bow limb is positioned within about the middle third of the length along the second bow limb between its coupling member pivotable connection point and its pulley pivotable connection point.

9. The bow of claim 7 wherein:

the riser pivotable connection point of the first bow limb is positioned within about the middle eighth of the length along the first bow limb between its coupling member pivotable connection point and its pulley pivotable connection point; and the riser pivotable connection point of the second bow limb is positioned within about the middle eighth of the length along the second bow limb between its coupling member pivotable connection point and its pulley pivotable connection point.

10. The bow of claim 7 wherein the first and second distal pivotable connection points and the first and second proximal pivotable connection points are arranged substantially collinearly.

11. The bow of claim 7 wherein:

each bow limb comprises a corresponding pair of substantially parallel, spaced-apart, elongated members and a corresponding transverse member secured to each of the corresponding pair of elongated members; and the corresponding riser pivotable connection point of each bow limb is located on the corresponding transverse member.

12. The bow of claim 7 further comprising:

a first pulley member pivotably connected to the first bow limb at the pulley pivotable connection point thereof;

a second pulley member pivotably connected to the second bow limb at the pulley pivotable connection point thereof; and a draw cable engaged with the first and second pulley members, wherein:

the first or second pulley member and the engaged draw cable are arranged so that pulling the draw cable to draw the bow results in deformation of the first and second bow limbs and pivoting movement of the first and second coupling members;

the first coupling member and the riser are arranged so that the pivoting movement of the first coupling member results in a decrease of an acute angle between the riser and the first coupling member;

the second coupling member and the riser are arranged so that the pivoting movement of the second coupling member results in a decrease of an acute angle between the riser and the second coupling member; and the riser, the first coupling member, the first bow limb, the second coupling member, and the second bow limb are arranged so that the deformation of the first and second bow limbs results in movement of the corresponding pulley pivotable connection points toward one another.

13. The bow of claim 7 wherein:

the riser has multiple first proximal pivotable connection points arranged on the riser between the handle portion and the first distal pivotable connection point, and the first coupling member is pivotably connected at the first pivotable connection point thereof to the riser at one of the multiple first proximal pivotable connection points thereof; and the riser has multiple second proximal pivotable connection points arranged on the riser between the handle portion and the second distal pivotable connection point, and the second coupling member is pivotably connected at the first pivotable connection point thereof to the riser at one of the multiple second proximal pivotable connection points thereof.

14. The bow of claim 7 wherein the first and second coupling members comprise substantially rigid members.

15. The bow of claim 7 wherein the first and second coupling members comprise flexible members.

16. A method for making an archery bow comprising:

pivotably connecting a first substantially rigid coupling member at a first pivotable connection point thereof to an elongated riser at a first proximal pivotable connection point thereof, the riser having a central handle portion, the first and a second proximal pivotable connection points arranged along the riser with the handle portion therebetween, and first and second distal pivotable connection points arranged along the riser with the handle portion and the proximal connection points therebetween;

pivotably connecting a first elongated bow limb at a riser pivotable connection point thereof to the riser at the first distal pivotable connection point of the riser, the first bow limb being adapted at a pulley pivotable connection point thereof to receive a pulley member pivotably connected thereto;

pivotably connecting the first bow limb at a coupling member pivotable connection point thereof to the first coupling member at a second pivotable connection point of the first coupling member, the coupling member pivotable connection point being arranged along the first bow limb between the riser and pulley pivotable connection points thereof;

pivotably connecting a second substantially rigid coupling member at a first pivotable connection point thereof to the riser at the second proximal pivotable connection point thereof;

pivotably connecting a second elongated bow limb at a riser pivotable connection point thereof to the riser at the second distal pivotable connection point of the riser, the second bow limb being adapted at a pulley pivotable connection point thereof to receive a pulley member pivotably connected thereto; and pivotably connecting the second bow limb at a coupling member pivotable connection point thereof to the second coupling member at a second pivotable connection point of the second coupling member, the coupling member pivotable connection point being arranged along the second bow limb between the riser and pulley pivotable connection points thereof, wherein:

the coupling member pivotable connection point of the first bow limb is positioned within about the middle third of the length along the first bow limb between its riser pivotable connection point and its pulley pivotable connection point; and the coupling member pivotable connection point of the second bow limb is positioned within about the middle third of the length along the second bow limb between its riser pivotable connection point and its pulley pivotable connection point.

17. The method of claim 16 further comprising:

pivotably connecting a first pulley member to the first bow limb at the pulley pivotable connection point thereof;

pivotably connecting a second pulley member to the second bow limb at the pulley pivotable connection point thereof; and engaging a draw cable with the first and second pulley members, wherein:

the first or second pulley member and the engaged draw cable are arranged so that pulling the draw cable to draw the bow results in deformation of the first and second bow limbs and pivoting movement of the first and second coupling members;

the first coupling member and the riser are arranged so that the pivoting movement of the first coupling member results in a decrease of an acute angle between the riser and the first coupling member;

the second coupling member and the riser are arranged so that the pivoting movement of the second coupling member results in a decrease of an acute angle between the riser and the second coupling member; and the riser, the first coupling member, the first bow limb, the second coupling member, and the second bow limb are arranged so that the deformation of the first and second bow limbs results in movement of the corresponding pulley pivotable connection points toward one another.

18. A method for making an archery bow comprising:

pivotably connecting a first coupling member at a first pivotable connection point thereof to an elongated riser at a first proximal pivotable connection point thereof, the riser having a central handle portion, the first and a second proximal pivotable connection points arranged along the riser with the handle portion therebetween, and first and second distal pivotable connection points arranged along the riser with the handle portion and the proximal connection points therebetween;

pivotably connecting a first elongated bow limb at a coupling member pivotable connection point thereof to the first coupling member at a second pivotable connection point of the first coupling member, the first bow limb being adapted at a pulley pivotable connection point thereof to receive a pulley member pivotably connected thereto;

pivotably connecting the first bow limb at a riser pivotable connection point thereof to the riser at the first distal pivotable connection point of the riser, the riser pivotable connection point being arranged along the first bow limb between the coupling member and pulley pivotable connection points thereof;

pivotably connecting a second coupling member at a first pivotable connection point thereof to the riser at the second proximal pivotable connection point thereof;

pivotably connecting a second elongated bow limb at a coupling member pivotable connection point thereof to the second coupling member at a second pivotable connection point of the second coupling member, the second bow limb being adapted at a pulley pivotable connection point thereof to receive a pulley member pivotably connected thereto; and pivotably connecting the second bow limb at a riser pivotable connection point thereof to the riser at the second distal pivotable connection point of the riser, the riser pivotable connection point being arranged along the second bow limb between the coupling member and pulley pivotable connection points thereof.

19. The method of claim 18 wherein:

the riser pivotable connection point of the first bow limb is positioned within about the middle third of the length along the first bow limb between its coupling member pivotable connection point and its pulley pivotable connection point; and the riser pivotable connection point of the second bow limb is positioned within about the middle third of the length along the second bow limb between its coupling member pivotable connection point and its pulley pivotable connection point.

20. The method of claim 18 further comprising:

pivotably connecting a first pulley member to the first bow limb at the pulley pivotable connection point thereof;

pivotably connecting a second pulley member to the second bow limb at the pulley pivotable connection point thereof; and engaging a draw cable with the first and second pulley members, wherein:

the first or second pulley member and the engaged draw cable are arranged so that pulling the draw cable to draw the bow results in deformation of the first and second bow limbs and pivoting movement of the first and second coupling members;

the first coupling member and the riser are arranged so that the pivoting movement of the first coupling member results in a decrease of an acute angle between the riser and the first coupling member;

the second coupling member and the riser are arranged so that the pivoting movement of the second coupling member results in a decrease of an acute angle between the riser and the second coupling member; and the riser, the first coupling member, the first bow limb, the second coupling member, and the second bow limb are arranged so that the deformation of the first and second bow limbs results in movement of the corresponding pulley pivotable connection points toward one another.

21. The method of claim 18 wherein the first and second coupling members comprise substantially rigid members.

22. The method of claim 18 wherein the first and second coupling members comprise flexible members.

* * * * *